US005911313A

United States Patent [19]

Gold

[11] Patent Number: 5,911,313

[45] Date of Patent: Jun. 15, 1999

[54] TWO DIMENSIONAL AND THREE DIMENSIONAL GLOVE COMPENSATOR

[76] Inventor: Danny Gold, 14 Tregunter Path, Tregunter Tower 2, Apt. 33B, Hong Kong, China

[21] Appl. No.: 09/015,479

[22] Filed: Jan. 28, 1998

Related U.S. Application Data

[60] Provisional application No. 60/036,524, Jan. 29, 1997.

[51] Int. Cl.[6] ..... A41D 19/00

[52] U.S. Cl. ..... 2/159; 2/158; 2/161.6; 2/164; 2/169

[58] Field of Search ..... 2/158, 159, 161.1, 2/161.6, 163, 164, 167, 169

[56] References Cited

U.S. PATENT DOCUMENTS

| | | | |
|---|---|---|---|
| 3,916,448 | 11/1975 | Hamel | 2/164 |
| 4,430,759 | 2/1984 | Jackrel . | |
| 5,020,161 | 6/1991 | Lewis, Jr. et al. | 2/164 |
| 5,349,705 | 9/1994 | Ragan . | |
| 5,548,844 | 8/1996 | Ceresia | 2/161.6 |

FOREIGN PATENT DOCUMENTS

| | | |
|---|---|---|
| 0683989 | 5/1994 | European Pat. Off. . |
| 2394310 | 6/1978 | France . |
| 9302578 | 2/1993 | WIPO . |

*Primary Examiner*—John J. Calvert
*Assistant Examiner*—Gary L. Welch
*Attorney, Agent, or Firm*—Aufrichtig Stein & Aufrichtig, P.C.

[57] ABSTRACT

The invention is generally directed to an improved glove having an inner liner including at least a waterproof breathable membrane layer formed as a generally two dimensional glove, an outer glove shell layer formed as a three dimensional glove pattern and a connecting member stitched or otherwise permanently fastened to the outer shell in strategically designed locations and secured by non piercing connection to the inner liner. An improved glove with increased compensation for the geometrical variance between the two dimensional inner layer and the three dimensional outer layer is provided.

12 Claims, 3 Drawing Sheets

TWO DIMENSIONAL AND THREE DIMENSIONAL GLOVE COMPENSATOR

This application claims benefit of Provisional Appl. No. 60/036,524 filed Jan. 29, 1997.

BACKGROUND OF THE INVENTION

This invention is generally directed to a glove and method of attaching a two dimensional inner glove to a three dimensional outer glove and in particular to the manner in which the layers are attached to each other so as to compensate for the differences in geometries of the two dimensional and three dimensional gloves.

In the past, some glove and mitt made from 2-dimensional inner liners were waterproof, and had breathable membranes. These membranes or membranes with backing support, are sealed in a 2-dimensional plane as it is not practical, with state of the art technology, to seal more than 2 layers. When a third layer is introduced, a gap is created which will allow water to penetrate. This can only be remedied with tape or liquid seals which are not commercially viable. These gloves are generally formed of an outer shell, an inner liner and an intermediate waterproof breathable membrane layer. The physical characteristics of the membrane layer are such that it is a very thin layer which is susceptible to piercing, ripping and other hazards of use which pierce the barrier layer formed by the membrane if utilized alone. The membrane layer ceases to operate in its intended use if the membrane layer is breached at any point, including by the use of stitching through the membrane layer.

The membrane layer is generally formed as a two piece glove layer formed from two identically shaped pieces which are attached to each other about the perimeter of the glove layer (hereinafter referred to as a two dimensional inner liner). This connection is usually done either by gluing, thermal or ultrasonic sealing or other non-invasive (non-stitched) approaches commonly utilized. In an effort to minimize the structural problems associated with the thin waterproof breathable membrane barrier some manufacturers have laminated or otherwise attached insulation or a slide layer onto the membrane layer. Generally this is done in sheets which are then cut and attached as traditionally had been done with the membrane layers. This also has the effect of allowing these gloves to be assembled with two discreet components, the outer shell and the membrane and inner liner layer as a single component.

Because of the geometries of the two dimensional glove, the gloves tend to be large in a number of areas of the hand and fingers which have caused various efforts to modify the glove liner in a fashion that prevents gapping, reversing and gripping of the membrane layer during use.

However, many of these gloves still suffer from a poor fit between the two dimensional membrane layer, either with or without another layer attached to it and the outer three dimensional, generally precurved outer shell layer.

The need to accommodate the volume necessary in a 2-dimensional pattern, to fit a 3-dimensional glove causes an excessive amount of material development around the circumference of the hand as described around the base of the thumb. This excess of material prevents a facile entry of the hand into the finger stalls, the excess material often blocking the entry. The problem is less obvious where there is an insulated 3-dimensional lining that lies between the 2-dimension insert and the 3-dimensional shell. In this case, the lining-to-insert-to-shell are factory formed and hemmed in position and the wearer is not aware of the problems. New technology, such as GORE-TEX Direct Grip have the waterproof breathable membrane laminated to a lining material that functions as a lining as well as an insert. In this case there is no three dimensional lining to support the insert in a comfortable position to allow ease of entry of the hand into the finger stalls. Accordingly, there is a need for an improved connection method for attaching a two dimensional inner glove to a three dimensional outer glove which compensates for the variations between the two gloves.

SUMMARY OF THE INVENTION

The invention is generally directed to an improved glove having an inner liner including at least a waterproof breathable membrane layer formed as a generally two dimensional glove, an outer glove shell layer formed as a three dimensional glove pattern and a connecting member stitched or otherwise permanently fastened to the outer shell in strategically designed locations and secured by non piercing connection to the inner liner. An improved glove with increased compensation for the geometrical variance between the two dimensional inner layer and the three dimensional outer layer is provided.

Another object of the invention is to provide improved compensator for connecting an outer, generally three dimensionally oriented glove layer to a inner, generally two dimensionally oriented layer by stitching a heat sensitive connection tape to the inner surface of the outer shell in strategic locations and then heat sealing the connector tape to the inner layer.

A further object of the invention is to provide an improved method of connecting an inner, generally two dimensionally oriented liner layer by stitching a heat sensitive tape to the inner surface of the outer shell in strategically located positions and then heat sealing the tape to the inner liner so that the two layers fit together and move in a natural fashion without bunching at the fingers.

Still another object of the invention is to provide an improved multi level glove or mitten in which a two dimensional layer is connected to a three dimensional layer in which one of the layers may not be pierced by stitching or similar invasive connection techniques and the other has a heat sealing tape stitched to it in strategic locations and the first layer is then attached to the layer having the stitched connector tape through heat sealant or similar non invasive connection with the connector in the strategic areas.

Still other objects and advantages of the invention will, in part, be obvious and will, in part, be apparent from the specification.

The invention accordingly comprises the features of construction, combinations of elements and arrangements of parts which will be exemplified in the construction as hereinafter set forth, and the scope of the invention will be indicated in the Claims.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENT

Figure 1:
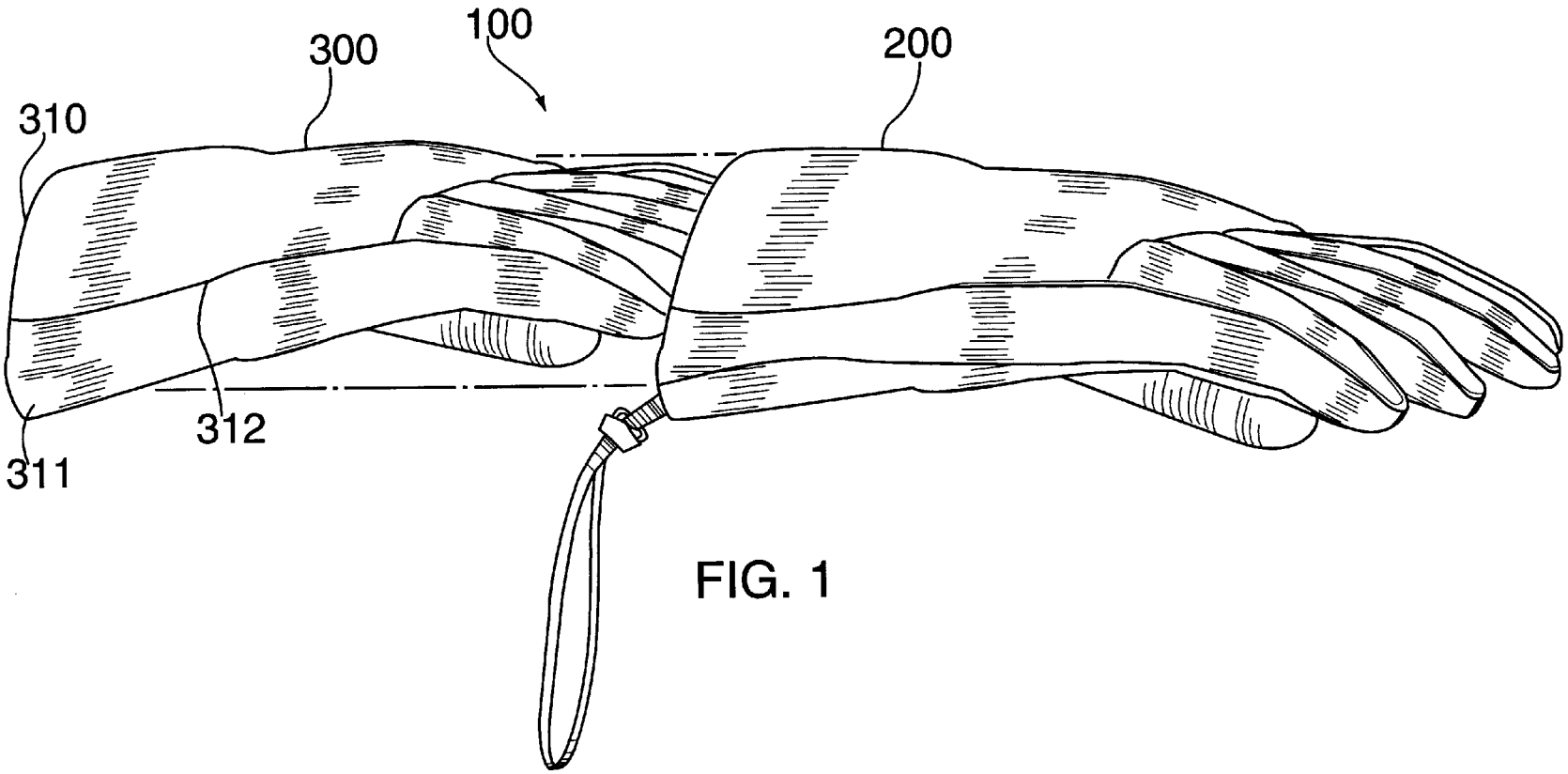
FIG. 1 is an exploded perspective view of a glove, generally constructed in accordance with a preferred embodiment of the invention.

Reference is first made to FIG. 1 wherein a glove, generally indicated as 100 constructed in accordance with a preferred embodiment of the invention is depicted. Glove 100 includes an outer shell 200 and an inner glove liner, generally indicated as 300. Outer shell 200 is constructed in accordance with conventional glove technology out of either leather, nylon or any of a variety of natural or synthetic, woven or non woven materials. Inner liner 300 is formed of two, generally identically shaped panels 310, 311 which are heat sealed around their perimeter along a seam 312 running along the side of the glove and around each of the fingers and thumb. This is a conventional technology utilized for assembly of waterproof breathable membrane glove layers. Generally, either heat sealing or ultrasonic sealing is utilized to fuse these layers together and maintain a solid barrier layer. Generally, a slide layer or inner liner layer is fixed to the inside of membrane layers 310 and 311. In this case, an inner slide layer, which is formed of a thin fabric is laminated directly to the membrane layer, identified in FIG. 5 as layer 301. The slide layer is identified in FIG. 5 as layer 302. Generally, the panels 310 and 311 are laminated to include the membrane layer 301 and the slide layer 302 prior to cutting and joining.

As noted above, one of the major problems in placing inner liner 300, which is formed as a two dimensional glove as a result of its being cut out of two flat panels, is that the fingers of the glove tend to have a large amount of excess material, particularly above the base of the fingers (i.e. toward the glove opening or top). This is due to the need to adapt to the bending of the fingers which changes the hand and finger geometries during regular use. In particular, the excess material results from having to adapt a pattern that will give adequate volume to the fingers (which is achieved in a three dimensional pattern with fourchettes). The pattern base presumes the finger volume and adds this to the palm side thereby creating the excess of material above the finger stalls and the thumb stall. The two dimensional glove pattern used for the inner liner poorly adapts to this and thus must be cut with sufficient clearance to allow the fingers to freely move and bend. In contrast, outer shell 200 is created with a three dimensional glove and structure in accordance with high quality glove design. The outer shell 200 includes finger portions 201, 202, 203 and 204 and thumb portion 205. In addition, side panels and fourchettes 211, 212, 213, 214 and 215 provide an outer shell glove shape 200 which is three dimensional in nature and matches the shape of a wearer's hand. This glove construction bends along with the wearer's hand in a more natural fashion thereby allowing the fingers to be cut closer to the actual dimensions of the wearer's hand. As a result of the large clearance of the inner liner, the excess material gathers immediately above the finger stalls and at the sides of the glove (on the side of the index finger and the pinky). There are three critical places where it is observed that the insert 300 has to be controlled to fit the three dimensional outer shell 200: by the baby finger, by the index finger and by the thumb. This makes it difficult to get the fingers into the stalls with prior art gloves. In these gloves the excess material would get in the way of the fingers' entry into the finger stalls without the compensation system.

When inner liner 300 is inserted into outer shell 200 as shown in FIG. 1, the portion of the fingers of inner liner 300 around the base of the fingers tends to have additional material which gaps and makes it difficult to insert the fingers into the glove 100.

Various methods have been utilized in an effort to attach an inner liner including membrane layer 301 to an outer shell without piercing the integrity of the inner liner and in an effort to prevent the inner liner from pulling out of the outer shell and causing the reentry of the hand to be difficult and prone to damage the barrier membrane. Applicant and others have filed applications directed to methods of attaching these elements together.

Figure 2:
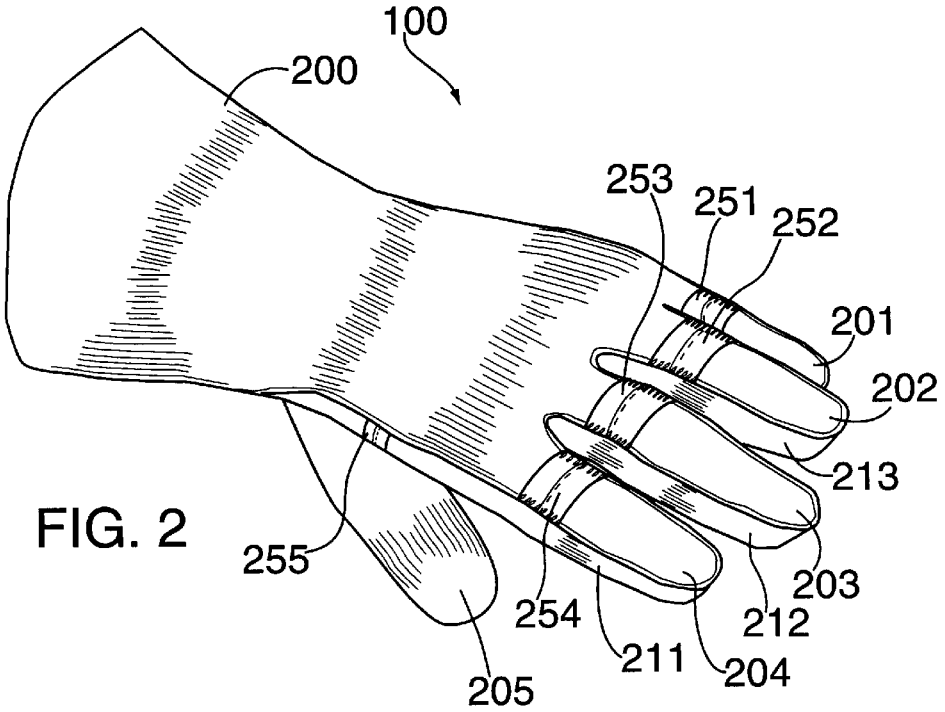
FIG. 2 is a prospective view, looking generally downward on the back of the outer shell of the glove of FIG. 1 in an inside out orientation utilized in construction of the glove.
Figure 3:
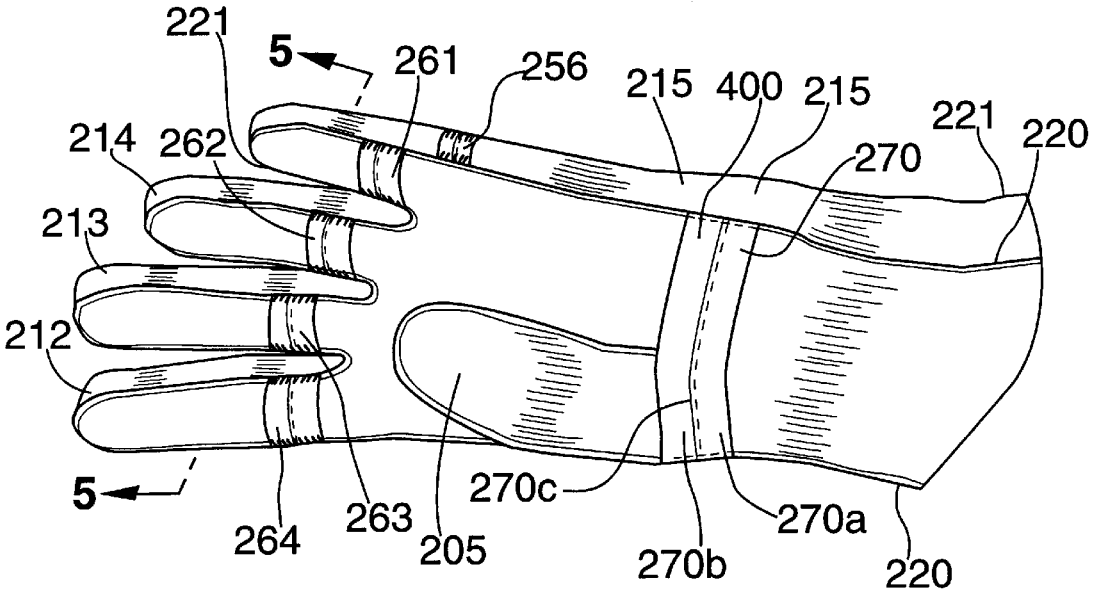
FIG. 3 is a prospective view, similar to the view of FIG. 2 of the same glove generally showing the palm side of the glove.
Figure 4:
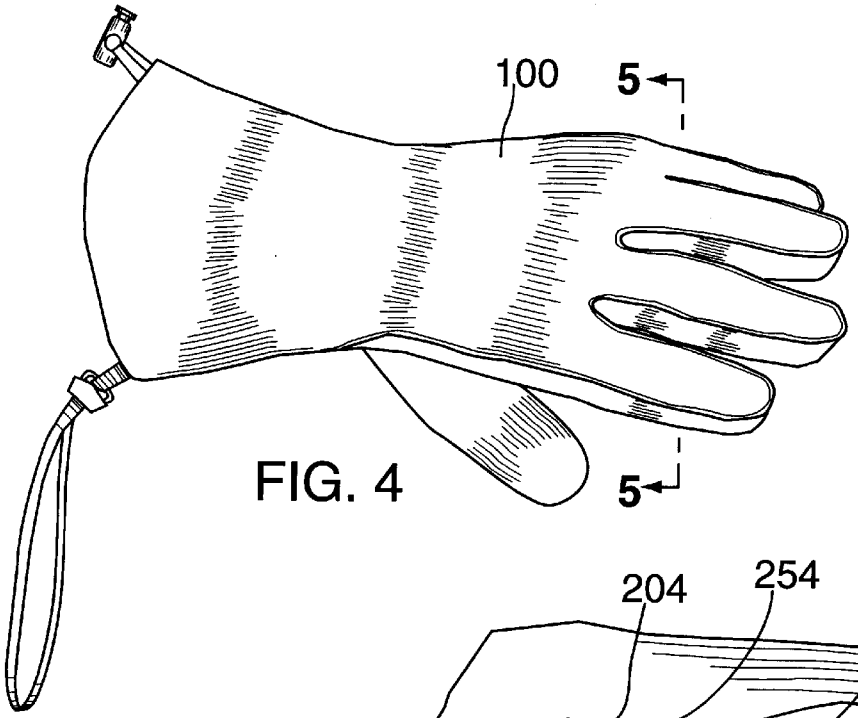
FIG. 4 is a prospective view of a glove constructed in accordance with a preferred embodiment of the invention.

In an effort to assure a strong positive attachment of the outer shell to the inner liner a heat sensitive tape, generally indicated as 400 (FIG. 3) is utilized in various locations on the inside surface of outer shell 200. The connection tape has a bonding surface on one surface of the surfaces. The tape is usually manufactured by companies making the membrane layers and is suitable for forming a strong bond with the membrane layer. As shown in FIGS. 2 and 3, in accordance with applicant's invention, a series of panels of tape 400 are sewn to the inner surface of outer shell 200. A series of four panels 251, 252, 253 and 254 are sewn to the seams 220 and 221 along the back of the four fingers directly above the crotch regions the fingers. Four panels 261, 262, 263 and 264 are fixed by stitching the seams to the palm side of the fingers proximate the crotch regions of the fingers. This placement tends to keep the excess material of the finger stalls, required to allow entry of the fingers into the two-dimensional inner liner, of the inner liner in place and prevent the excess material in the inner liner from interfering with the openings of the finger stalls when the wearer's hand is inserted into the glove. Generally, there are tabs outside of the heat sealed portion of the inner liner at the fingertips which can be stitched to the tips of the outer shell prior to inverting the outer shell to its final orientation. In addition, a panel of the tape material 400 identified as 270 is stitched onto the palm side of the glove just below the base of the thumb region. This prevents the hand portion of the glove from moving about. Importantly, it restricts this area of the inner shell which likewise has a tendency to gap and interfere with the access of the hand into the glove. Alternatively, this panel 400 can be omitted or supplemented by a stitch of the lining 300 Finally, two additional panels 255, 256 along the sides of the glove are utilized to further fix the inner shell firmly in the correct position with the gapping regions of the two dimensional inner shell properly positioned for flexibility without interfering with entry and removal of the hand from the glove. By way of example, panel 270, shown in FIG. 3 is shown as having a first section 270*a* and a second section 270*b* connected by stitching 270*c*. In this embodiment, two separate panels are stitched together, prior to attachment to outer shell 200. However, in other preferred embodiments, a sufficiently wide single strip of the tape 400 is used. The single wider panel 270 is preferred. The ends of the tape panel 270 are sewn into seam 220 extending around the palm side of the glove. Stitching 270*c* can also, if desired be stitched through outer shell 200 so as to form an even stronger bond with outer shell 200. However, it can likewise be accomplished with stitching of the panel 270 and the other panels in the finger regions along the sides only in the glove seams.

Once each of the tape panels are properly positioned and secured to the outer shell, the tabs at the ends of the fingertips are stitched to the tips of the fingers of the outer shell. Then, outer shell 200 is inverted to its finished condition in which the inner surface, shown in FIG. 2 and FIG. 3 on the outside, lies on the inside of the glove. Next, inner shell 300 is positioned within outer shell 200 so that all the fingers are properly located and the tape stitches are in the correct places. When inner liner 300 is aligned with outer shell 200, generally on a hand form (not shown), heat is applied to the regions of the glove on which the heat sensitive tape is located. The effect of this is to form a solid bond between the panels of heat sensitive tape 400 and membrane surface 301 of the inner liner 300. This assures that the fingers have clear access to the finger stalls without the excess material interfering.

Figure 5:
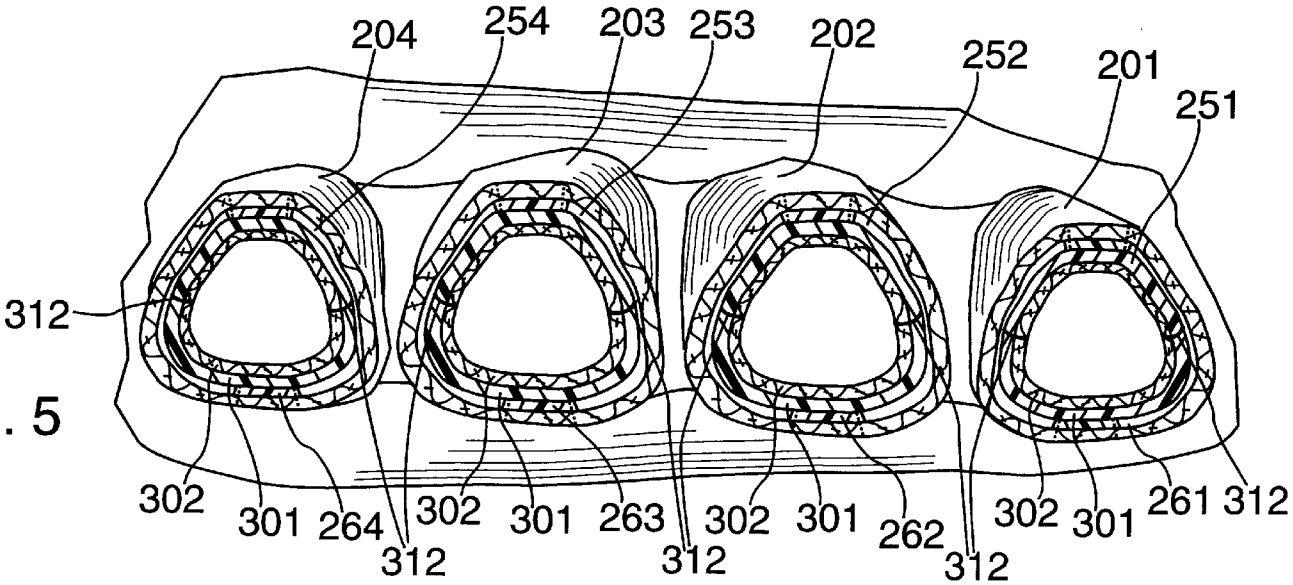
FIG. 5, is an enlarged cross sectional view taken along line 5—5 of FIG. 4.

As shown in FIG. 5, which provides a cross sectional view of the finger portions of glove 100 in its assembled state, the various layers of the glove are shown. The outer shell 200 is shown in the region of the tapes 251, 252, 253, 254, 261, 262, 263, 264. As seen clearly there is stitching holding the panels 251–254 and 261–264 to outer shell 200 and an adhesive contact with membrane layer 301 of inner liner 300. Inner slide layer 302 is shown inside membrane layer 301. In the preferred embodiment inner slide layer 302 is laminated to the inside of membrane layer 301 and forms an inner slide surface to allow the wearer's fingers and hand to slide easily into the glove without damaging membrane layer 301.

A new insert, in which a fleece layer is laminated to a membrane, may also be used in accordance with the invention. It is difficult to seal the insert effectively on the lining, or sliding, surface of the insert. Accordingly, the insert is sealed on the membrane side and reversed to fit in the glove. This leaves the sealed selvage on the inside. In the finished glove, the sealed selvage is not obvious and is generally not felt too much by the wearer. To position this insert, a similar technique is used as describe above. However, no tabs are utilized. In order to stitch the fingers and the thumb to the shell 200, tabs are added to the membrane layer with heat sensitive tape which overlap the finger ends when applied. These tabs are then stitched to shell 200 as described above.

In addition, tapes which are adhered to the liner in critical locations, such as below the finger and below the thumb on the palm side of the liner are then stitched to the other end of the tape(or heat sealed) to the outer shell. Alternatively, a double cold adhesive tape could be applied to the insert 300 and cold taped to a heat sensitive tape which is in turn heat sealed to shell 200. More preferably, if a tape with one side or part which has a cold sealing adhesive and the other side or part has a heat sealing adhesive, this can be accomplished with only a single tape.

Accordingly, an improved two dimensional to three dimensional glove compensator method for attaching a two dimensional waterproof breathable membrane layer to a three dimensional outer glove shell is provided.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. Multi layer glove with mated two dimensional and three dimensional layers, comprising:

a two dimensional inner liner formed from two glove pattern segments joined at or about a substantial portion of the perimeter of the pattern segments;

an outer shell glove layer sized to fit over the inner glove liner layer, said outer glove shell being formed as a three dimensionally oriented glove layer from a number of panels, greater than two; and heat sensitive coupling means stitched to selected locations on the inner surface of the outer glove shell and heat sealed to the outer surface of the inner glove liner to firmly secure the inner glove liner to the outer glove shell and to compensate for the differences in size and movement of the inner glove liner and outer glove shell.

2. The multi layer glove of claim 1 further includes an inner slide layer coupled to the glove inside of the inner liner.

3. The multi layer glove of claim 2 wherein the inner slide layer is also an insulating layer.

4. The multi layer glove of claim 1 wherein the heat sensitive coupling means is a heat sensitive tape.

5. The multi layer glove of claim 1 wherein the heat sensitive coupling means is used at the tips of each finger.

6. The multi layer glove of claim 1 wherein the heat sensitive coupling means is used at at least one of the base of the thumb, base of the index finger and the base of the pinky finger.

7. The multi layer glove of claim 1 wherein the heat sensitive coupling means is used at each of the base of the thumb, base of the index finger and the base of the pinky finger.

8. The multi layer glove of claim 1 wherein the inner liner is laminated to a fleece layer prior to assembly of the glove.

9. The multi layer glove of claim 8 wherein the fleece layer is inside the inner liner in the assembled glove, with the inner liner sandwiched between the outer shell and the fleece layer.

10. The multi layer glove of claim 1 further comprising secondary heat coupling means for securing the inner liner to the outer shell without piercing the inner liner in critical regions for controlling excess material of the inner liner from interfering with access to the finger stalls.

11. The multi layer glove of claim 10 wherein the secondary heat coupling means is secured to the liner at the base of the fingers and thumb.

12. The multi layer glove of claim 1 where the secondary heat coupling means comprises a tape which is cold adhering on one surface or part and heat adhering on the other surface or part.

* * * * *